United States Patent [19]

Larsen

[11] 4,294,409

[45] Oct. 13, 1981

[54] SHOWER HEAD AND VALVE ASSEMBLY FOR CAMPING SHOWER

[76] Inventor: Charles H. Larsen, 901 Date St., Rawlins, Wyo. 82301

[21] Appl. No.: 33,035

[22] Filed: Apr. 25, 1979

Related U.S. Application Data

[63] Continuation of Ser. No. 713,714, Aug. 12, 1976, Pat. No. 4,151,616.

[51] Int. Cl.[3] ..... B05B 1/30

[52] U.S. Cl. ..... 239/577; 239/578; 239/583; 4/617; 251/322

[58] Field of Search ..... 239/577, 578, 583; 251/293, 294, 321, 322; 4/599, 602, 617

[56] References Cited

U.S. PATENT DOCUMENTS 1,403,509 1/1922 Long ..... 251/322

2,764,324 9/1956 Landreth ..... 251/322 X

FOREIGN PATENT DOCUMENTS 596687 1/1948 United Kingdom .

*Primary Examiner*—Richard A. Schacher

*Attorney, Agent, or Firm*—John E. Reilly

[57] ABSTRACT

The present invention includes a novel and unique combination poncho or rain garment with means adapted for suspending the poncho from an overhead object in a manner whereby a portion of the waterproof fabric of the poncho forms a baglike configuration for containing a quantity of water and a water dispensing means in the form of a shower head mounted in the poncho for allowing the water to be drawn from the reservoir in the bag configuration for use in washing and showering. The shower head is uniquely adapted for this purpose having an integral valve assembly which can be opened and allowed to close with the use of only one hand, as well as maintained in the full open position without the necessity of maintaining manual force on the valve operating mechanism.

18 Claims, 13 Drawing Figures

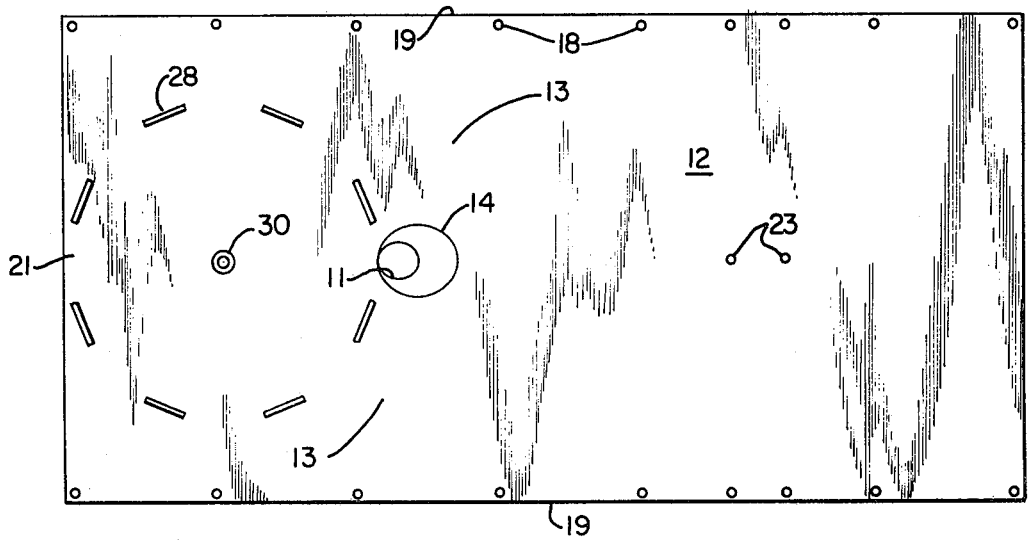
FIG. 3
FIG. 4
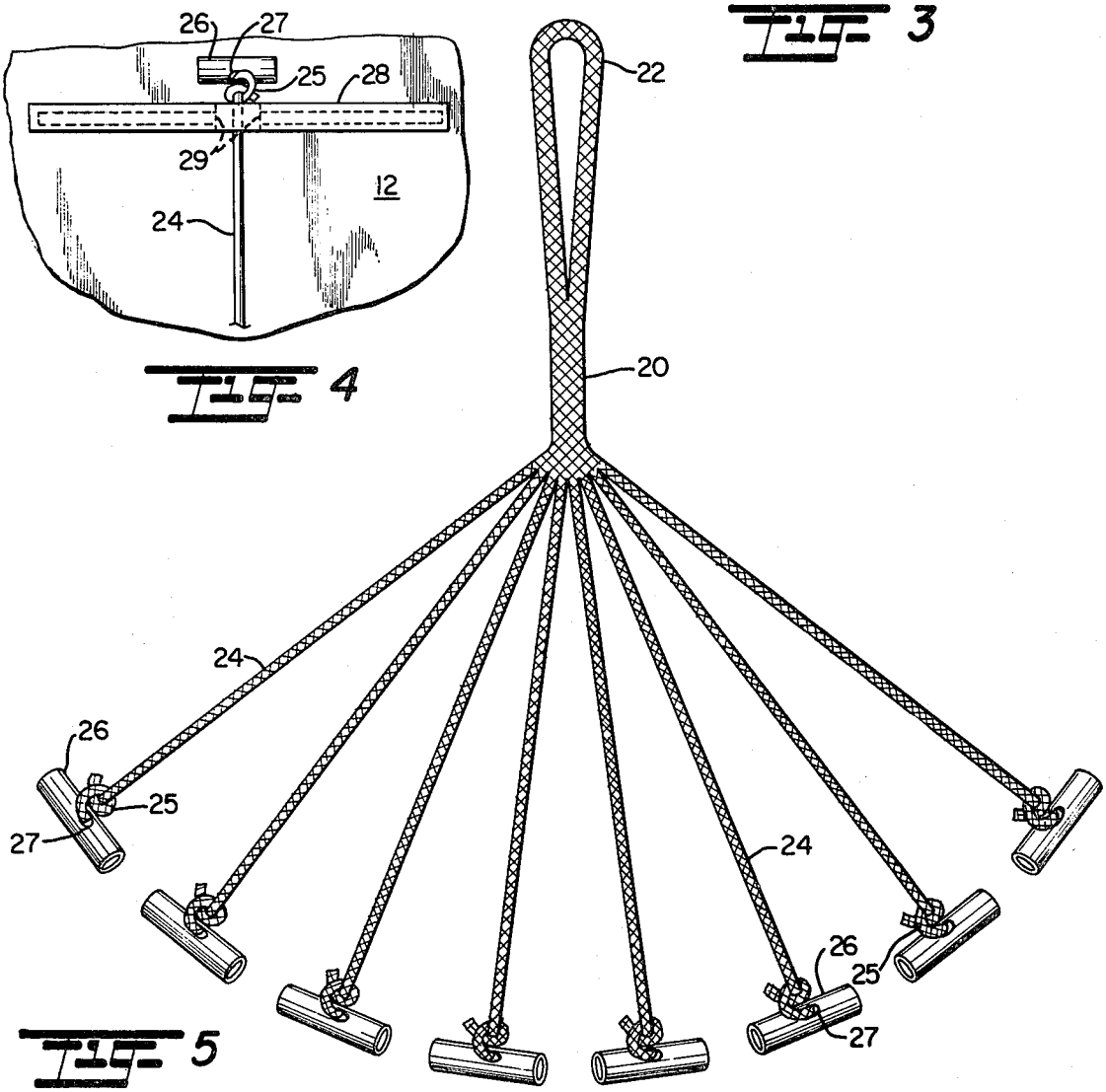
FIG. 5

SHOWER HEAD AND VALVE ASSEMBLY FOR CAMPING SHOWER

BACKGROUND OF THE INVENTION

This application is a continuation application of Ser. No. 713,714, filed Aug. 12, 1976 in the United States Patent and Trademark Office under the title of CAMPING SHOWER, now U.S. Pat. No. 4,151,616.

The present invention relates generally to portable shower apparatus, and more particularly relates to a portable camping shower with a manual cord operated valve in combination with a waterproof protective rain garment.

Campers, backpackers, soldiers and other persons who spend long periods of time away from civilization have long recognized the need for a portable shower facility which is preferably collapsible and easily packed with a minimum of space, such as, for carrying in a backpack or saddlebag. Numerous devices have been tried in the past with varying degrees of success. For example, the U.S. Pat. No. 1,241,764 issued to Pritchett, 1,398,208 issued to Trial, 1,844,038 issued to Hooker, 2,403,430 issued to Andrews et al, and 3,391,409 issued to Gatley, all disclose collapsible waterproof fabric reservoirs with hoops at the top and shower head attachments at the bottom. The U.S. Pat. No. 1,330,312 issued to Figueroa discloses a portable shower with a foldable shower curtain and shower head arrangement for packing in a hand bag that also serves as a water reservoir. Also, the U.S. Pat. Nos. 785,233 issued to Simpson, 1,147,748 issued to Rutland, and 1,330,312 issued to Figueroa all include shower valves of various construction which are operated by pulling suspended chains or cords.

While all of the above-cited patents disclose portable or collapsible shower apparatus which have been successful in various degrees in meeting the needs for showers away from civilization, the present invention provides improvements in several respects. As mentioned above, a primary concern of most persons who spend time away from civilization is to be able to carry along with them the essential equipment necessary for survival and for some minimum level of creature comfort while not requiring so much space or weight as to become inconvenient and unduly cumbersome. One item often included and considered necessary for survival and comfort by many such persons is a waterproof protective rain garment such as a full-length slipover poncho, sometimes including a hood. The present invention utilizes the waterproof fabric of such a protective rain garment for the alternate function of a water reservoir for a portable shower, thereby eliminating the necessity to carry an additional piece of equipment. The invention also includes an improved shower head which can be operated with a pull cord or chain that is more compact, reliable, and convenient to use than those disclosed in the prior art.

SUMMARY OF THE INVENTION

It is an object of the present invention to provide a new and improved portable shower apparatus for suspension from an overhead object.

It is another object of the present invention to provide an apparatus in combination with a waterproof protective garment for using the waterproof fabric of such a protective garment to function both as a portable shower and as protection from inclement weather.

It is yet another object of the present invention to provide a combination waterproof garment in the form of a poncho with a solid cape portion which can be suspended from an overhead object for use as a water storage reservoir and water dispensing means for converting said cape portion to a shower apparatus.

Still another object of the present invention is to provide a new and improved compact shower head and valve apparatus for a portable shower adaptable for use with a collapsible shower made of waterproof fabric.

A still further object of the present invention is to provide a compact, dependable shower head for use with a portable shower including a spring-loaded valve normally biased in closed position which can be opened with a pull cord or chain.

Yet another object of the present invention is to provide an improved shower head with a spring-loaded valve normally biased in a closed position with means for retaining said valve in an open position without the necessity of maintaining tension on the pull cord.

The present invention is directed to a novel and improved portable shower apparatus in combination with a waterproof garment which can be used in the field by campers, backpackers, soldiers and the like. The shower is comprised of a waterproof fabric with a plurality of detachable cords depending from loops for suspending said fabric from an overhead object in a bag-like configuration appropriate for containing a quantity of water sufficient to supply a shower of reasonable duration. A shower head with a spring-biased valve is also provided to conduct water from the side of the fabric forming the inside of the bag through the fabric to the opposite side where the water flows by gravity through shower nozzles. The valve is biased toward a normally closed position and is opened by pulling an attached cord or chain. The valve is designed with a valve stem that can be cocked sideways away from its normal axial alignment when in the open position to engage a portion of the valve housing to retain the valve open against the bias of the valve stem toward the normally closed position. In one embodiment, the valve stem is adapted to engage the lower portion of the housing and a bias spring is positioned outside the housing in the reservoir. A second embodiment with a bias spring positioned inside the housing is more compact and suitable to be worn as a component of a garment. In this second embodiment, the valve stem is adapted to engage a surface inside the valve housing when the valve stem is cocked sideways to retain it in the open position. The valve stem is also removable to further enhance the compactness and wearing comfort of the design for use in combination with a garment.

BRIEF DESCRIPTION OF THE DRAWINGS

Other objects, advantages and capabilities of the present invention will become more apparent as the description proceeds, taken in conjunction with the accompanying drawings, in which:

FIG. 3 is a plan view of the combination protective garment and portable shower apparatus;

FIG. 4 is an enlarged view of the suspension apparatus attachment means on a portion of the rain garment;

FIG. 5 is an elevational view of the suspension apparatus;

DETAILED DESCRIPTION OF THE PREFERRED EMBODIMENT

Figure 2:
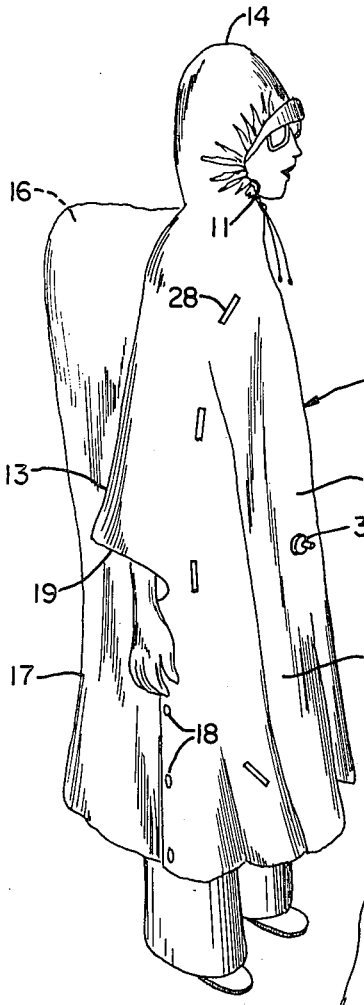
FIG. 2 is a perspective view of the portable shower apparatus in its dual function of being worn as a protective rain garment.
Figure 1:
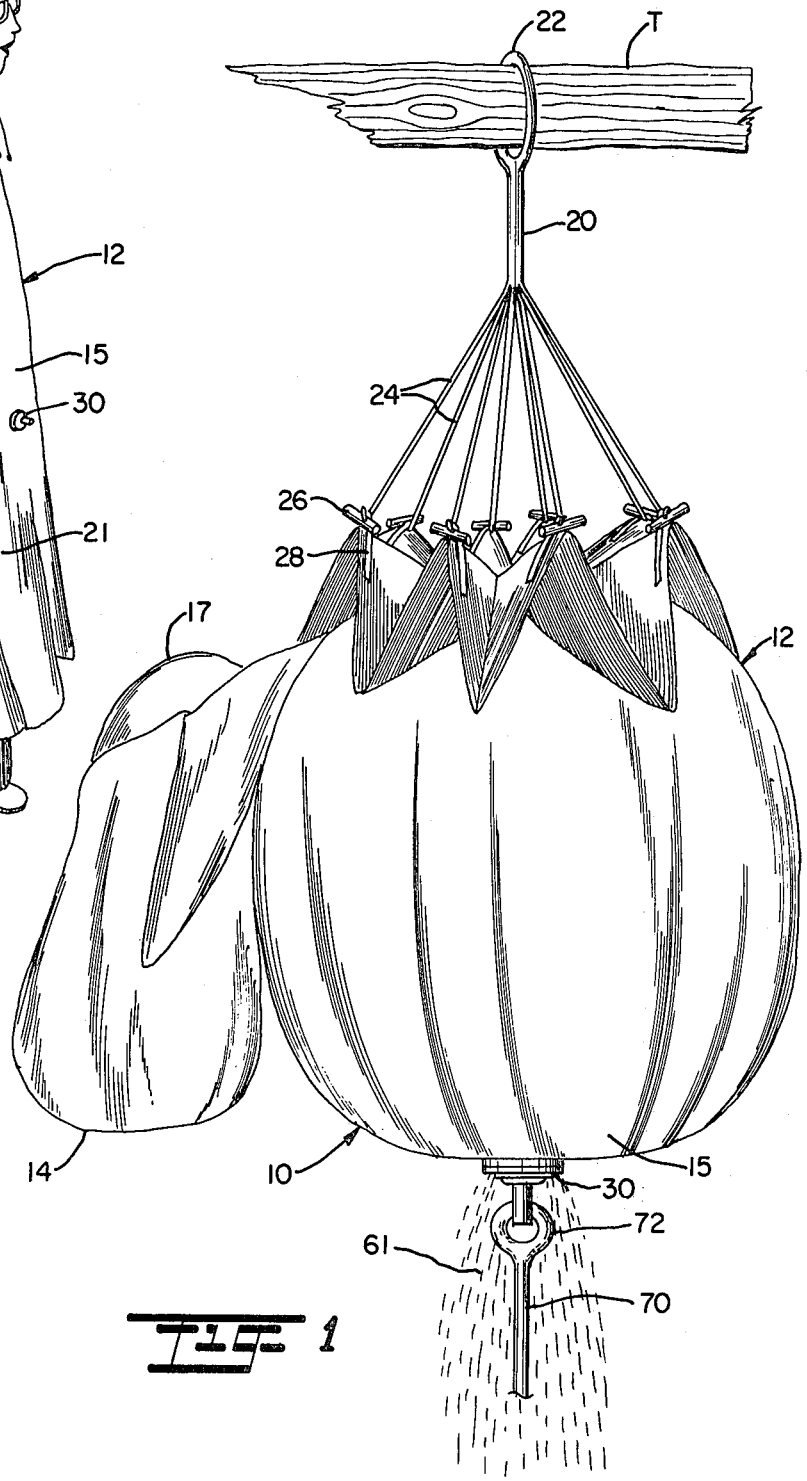
FIG. 1 is a side elevational view of the portable shower apparatus filled with water and suspended from an overhead object.

A portable shower apparatus 10 in accordance with the present invention is illustrated in FIG. 1 full of water and suspended from an overhead object such as the branch of a tree T. FIG. 2 illustrates the preferred embodiment of the invention being worn as a water-resistant protective garment or poncho 12. The garment 12 has an opening 11 for the head, a hood 14, a coat or body covering 15 and an extra length of fabric on the back 17 to cover a backpack 16. Expandable snap-fasteners 18 are provided along the sides of the garment to fasten the front and rear portions together while the garment is being worn, said snap-fasteners being positioned to fasten the fabric in such a manner as to allow arm openings 19 in sleeve portions 13 of the fabric which extend from over the shoulders. Additional snap-fasteners 23 are also provided on the excess back portion 17 to retain the excess fabric in a partially rolled-up position when the poncho is being worn, but not with a backpack.

Essentially, the preferred embodiment of the present invention utilizes a portion of the waterproof fabric of a protective garment 12 for the alternative application as a water container or reservoir of a portable shower. The suspension cord 20 with a loop 22 at one end and a plurality of strands 24 depending from the other end is provided to hold the waterproof fabric 12 in a suspended position for use as a shower reservoir. The suspension cord 20 is removably attached to the coat 15 so that the cord 20 can be detached from the coat when it is desired to use the garment as a poncho 12, as shown in FIG. 2.

The attachment means is comprised of a plurality of straps 28 permanently affixed to the fabric of the garment 12 in a substantially circular pattern on the front portion 21 of the poncho. The strap 28 is attached to the fabric of the garment 12 at both ends leaving a narrow gap or loop 29 near the center of the strap 28 which is not attached to the fabric 12. At the free end of each depending strand 24, a segment of elongated tube 26 is fastened at midspan to the strand 24, such as by threading the end of the strand 24 through a transverse hold 27 in the midspan of the tube 26 and securing it in a knot 26. Thus it can be appreciated that a tube 26 can be passed longitudinally through the gap 29 in strap 28 drawing the knot 25 and the end of strand 24 through the gap 29 also, and when entirely through the gap 29, the tube 26 can be turned transverse to the gap 29 in which position its length dimension is too great to pass transversely back through the gap 29 whereby the strand 24 will be retained in this attached position to the fabric 12 by the permanently fastened portion of the strap 28. When all of the depending strands 24 are attached to the waterproof garment 12 in this manner to form a water container for a shower reservoir as shown in FIG. 1, the reservoir can be filled with water and suspended to an overhead object for use as a shower.

Also as shown in FIG. 1, the excess fabric 17 of the protective garment 12 which is not utilized directly as a water reservoir for the shower can be folded and conveniently stuffed into the hood 14 as shown in FIG. 1, or it can be allowed to drape downward alongside the shower to serve as a privacy curtain or wind screen.

A combination shower head and valve 30 is permanently attached to the waterproof fabric 12 at the approximate center of the circular pattern formed by the straps 28, as seen in FIGS. 1, 2, and 3. The combination shower head and valve 30 provides a closable conduit through which water can pass from the reservoir through the fabric 12 in gravity flow as a shower onto a user standing under the shower head 30.

Figure 6:
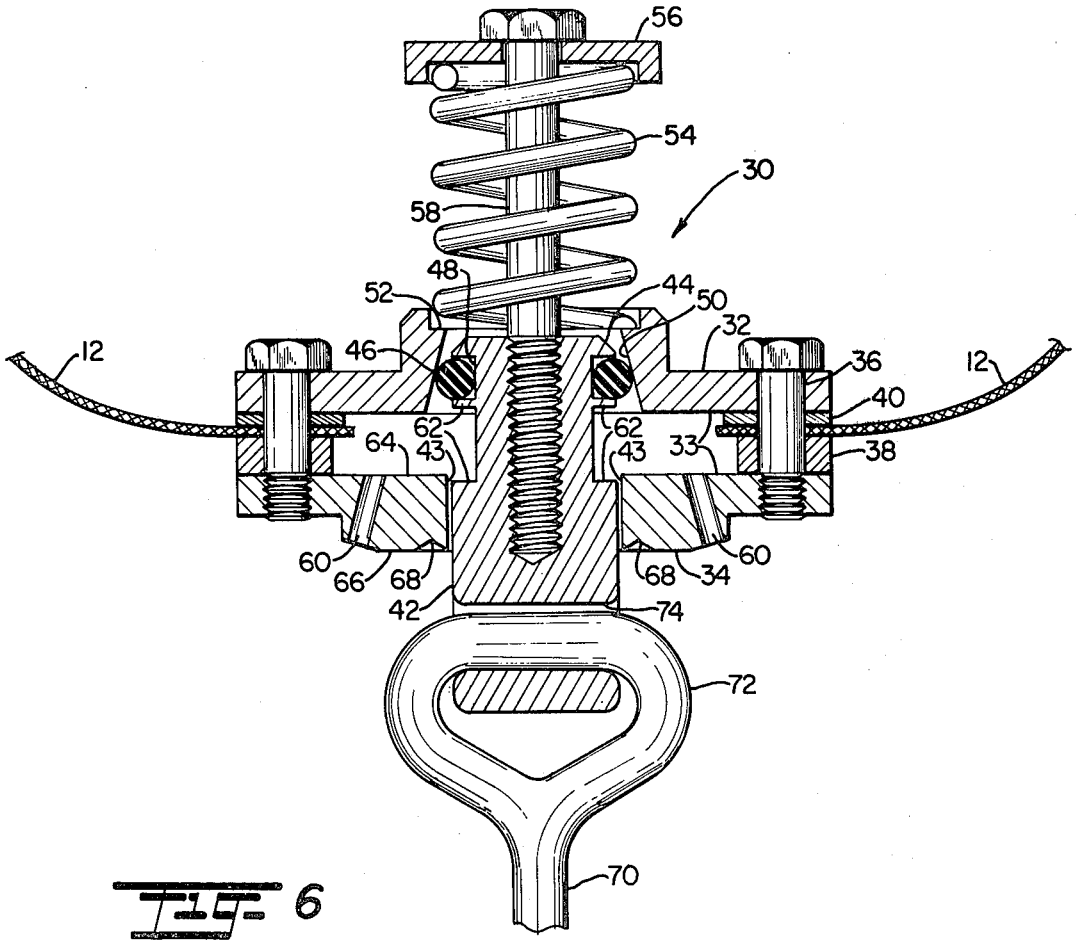
FIG. 6 is an enlarged cross-sectional view in elevation of one embodiment of the shower head apparatus.
Figure 7:
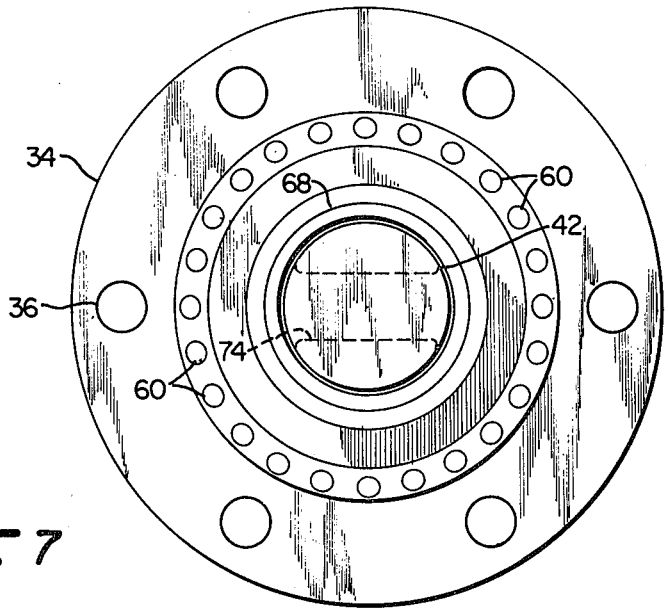
FIG. 7 is a bottom plan view of the shower head apparatus of the first embodiment.

The unique structural configuration of the shower head 30 is best seen in FIGS. 6 and 7. It is formed of an upper body portion 32 and a lower body portion 34 fastened together by bolts 36 which are threadedly received into the lower body portion 34. A spacer ring 38 is provided to maintain the upper body portion 32 and the lower body portion 34 a spaced distance apart in relation to one another to form a water distribution chamber 33 therebetween. The shower head 30 is attached to the waterproof fabric 12 by sandwiching the fabric 12 between the spacer ring 38 and the upper body portion 32. A gasket 40, preferably of rubber or other similar waterproof material, is also provided between the fabric 12 and the upper body portion 32 to effect water tightness.

A valve is provided at the center of the shower head 30 to regulate the flow of water from the reservoir through the shower head. The valve is comprised of a valve stem 42 oriented for vertical travel in relation to the valve guide 43. On the top end of the valve stem 42 is a beveled valve face 44 and immediately below the valve face 44 is a circumferential groove 48 around the entire valve stem which retains an O-ring seal 46 surrounding the circumference of the valve stem 42.

A beveled valve seat 50 is defined on the side of the water conduit in the upper body portion 32. When the valve stem 42 is urged upwardly causing the O-ring seal 46 to contact the valve seat 50, water is effectively prohibited from flowing out of the reservoir 12. However, when the valve stem 42 is moved downward carrying the O-ring seal 46 away from contact with the valve seat 50, water is allowed to flow from the reservoir through the upper body portion 32 and into the distribution chamber 33. From the distribution chamber 33, the water flows through a plurality of shower nozzles 60 defined by holes through the lower body portion 34. Of course, from the shower nozzle 60, the water free-falls in the form of a shower onto the user below as indicated at 61 on FIG. 1.

The shower head valve in this invention is also provided with a spring 54 mounted under compression urging the valve stem 42 to a normally closed position. The spring 54 is positioned in a spring seat 52 defined around the conduit in the upper body portion 32 just over the valve seat 50. The spring 54 is retained in a compressed state by a keeper 56 which is maintained in a spaced relation to the top of the valve stem 42 by a keeper bolt 58 which is threadedly received into the valve stem 42. It can be appreciated that the spring 54 in its compressed state reacts at the lower end against the spring seat 52 in the upper body portion 32 and at the other end against the keeper 56 which tends to urge the valve stem 42 with the O-ring seal 56 into sealing contact with the valve seat 50 in the upper body portion 32. It is also obvious that a tension force pulling on the lower end of the valve stem 42 sufficient to overcome the force of the spring 54 will cause the valve stem 42 and the O-ring seal 46 to move downwardly in relation to the valve guide 43 and the valve seat 50 allowing water to flow from the reservoir through the shower head as described above. Release of such a tensile force on the valve stem 42 would, of course, allow the valve stem 42 to return to its closed position.

For the convenience of a person using the shower, a valve cord 70 is provided with a loop 72 threaded through a hole 74 in the valve stem 42. Thus, a person using the shower can conveniently open the valve by pulling on the valve cord 70 to start the shower, and he can shut off the shower by simply releasing his pull on the valve cord 70. Of course, the rate of water flowing through the valve can be regulated by the amount of force applied to the valve cord 70 which varies the effective distance between the O-ring seal 46 and the valve face 50 resulting in larger or smaller area through which water can flow and thereby effecting the rate of flow.

The user may also desire to open the valve and to have the valve remain open without the user having to maintain the tensile force on the valve cord 70, such as while he is soaping and washing with both hands. To accommodate the user in this fashion, a circular channel 62 is provided around the entire circumference of the valve stem 42 immediately below the O-ring seal 46 and corresponding circumferential groove 48. The width of channel 62 is sufficient to span the thickness of the valve guide 43 and deep enough so that the valve guide 43 between the internal face 64 and the external face 56 of the lower body portion 34 can be inserted therein. Consequently, when the valve stem is pulled open a distance far enough to align the internal face 64 and external face 66 of the lower body portion with the channel 62, a slight lateral force on the valve stem will cause the valve guide 43 to be inserted into the channel 62. Then when the pulling force on the valve cord 70 is released, the lower face of channel 62 will bindingly engage the lower face 66 whereby the valve stem 42 will be prevented from returning to the closed position. A circular groove in the external face 66 defines a notch 68 which assists in maintaining the valve stem 42 in the above-described cocked open position. A simple pull on the valve cord 70 sufficient to overcome the force of spring 54 and directed slightly toward the center of the valve will cause the channel 62 to become disengaged from the valve guide 43 thereby allowing the valve to close again when the tensile force on the valve cord 70 is released.

Figure 8:
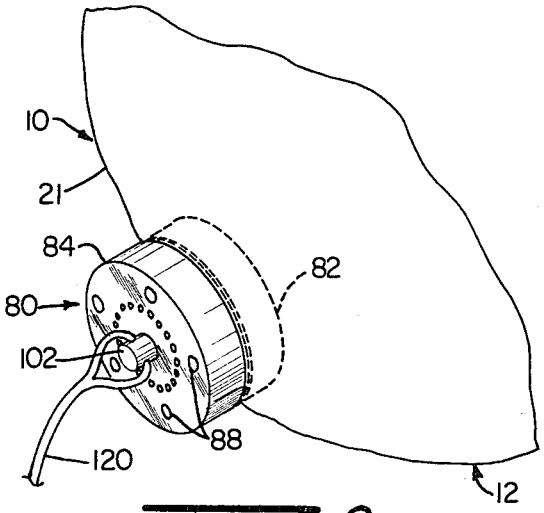
FIG. 8 is a perspective view of the second embodiment of the shower head apparatus positioned in a fragmentary portion of the shower reservoir.
Figure 9:
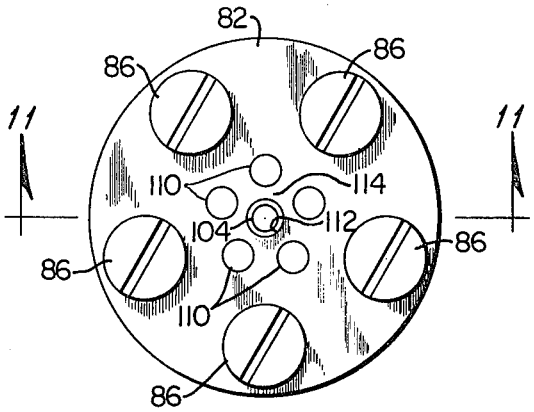
FIG. 9 is a top plan view of the second shower head embodiment.
Figure 10:
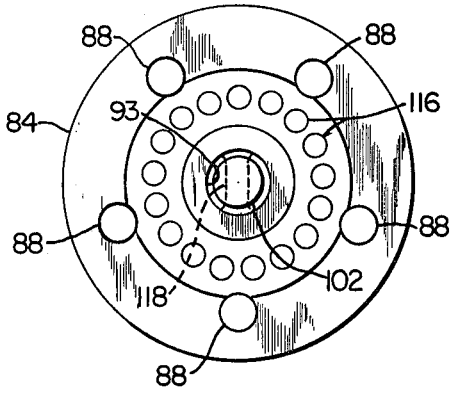
FIG. 10 is a bottom plan view of the second embodiment of the shower head.

A second embodiment of the shower head and valve apparatus 80 is shown in FIGS. 8 through 13. As shown in FIG. 8, the second embodiment of the shower head and valve apparatus 80 is also permanently attached to the waterproof fabric 12 and provides a closable conduit through which water can pass from the reservoir through the fabric 12 in gravity flow as a shower onto a user standing under the shower head 80.

The shower head and valve apparatus 80 is comprised of an upper body portion 82 and a lower body portion 84 positioned together to enclose a distribution chamber 89 in the interior thereof. The fabric wall 12 of the reservoir is sandwiched between respective flanges 83, 85 of the upper and lower body portions 82, 84, along with a gasket 90 positioned therein as a seal. Bolts 86 are inserted through holes 87 in the upper body portion and threaded into the internally threaded holes 88 in the lower body portion to fasten the upper and lower body portions 82, 84 together and to tightly squeeze the gasket 90 and fabric 12 therebetween.

A plurality of inlet orifices 110 are positioned around a central inlet orifice 112, all of which extend through the upper body portion 82 from the exterior thereof into the chamber 89. The upper portion of the chamber 89 is tapered to converge inwardly forming a tapered valve seat 100 along its walls.

The lower body portion 84 has a central hole 93 extending from the exterior thereof into the chamber 89 in axial alignment with the central inlet orifice 112. This hole 93 functions as a valve guide in which a valve stem 102 is positioned. A plurality of outlet ports 116 are distributed in spaced-apart relation around the central hole 93 in the lower body portion 84 and extend from the chamber 89 downwardly and outwardly to the exterior of the lower body portion 84.

The valve stem 102 includes a threaded portion 106 at its upper end, a finger retainer 104 protruding axially upward from its upper end beyond the threaded portion 106, and a transverse hole 118 through its lower portion. A disk 94 having an internally threaded bore 97 therethrough is threadedly attached to the threaded portion 106 of the valve stem 102. The disk 94 includes an enlarged collar 99 extending radially outward from the valve stem 102 with a valve face 95 around the peripheral surface of the collar 99. The valve face 95 has a groove 98 around its peripheral surface for receiving and retaining an O-ring seal 96 therein.

Figure 11:
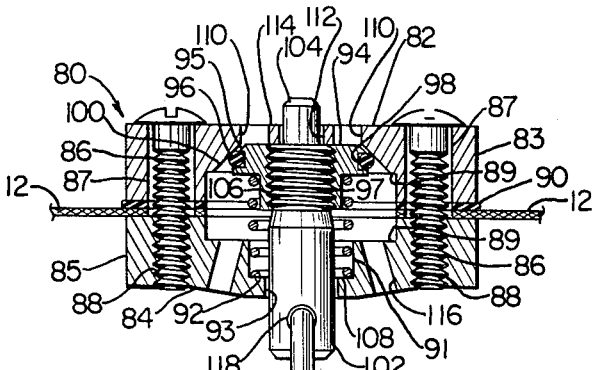
FIG. 11 is a cross-sectional view of the shower head of the second embodiment taken along lines 11—11 of FIG. 9, the valve in this view being shown in closed position, and the valve stem when removed shown in broken lines.

A coiled compression spring 108 is positioned in the chamber 89 around the valve stem 102 between the collar 99 and spring seat 92 at the bottom of enlarged bore 91 in the lower body portion 84. The compression spring bears against the spring seat 92 on one end and against the collar 99 on the other end to bias or urge the valve stem 102 upwardly into closed position with the O-ring seal 99 in abutment against the valve seat 100. In this closed position as shown in FIG. 11 water is prevented from flowing downwardly through the inlet orifices 110, 112 into the chamber 89.

Figure 12:
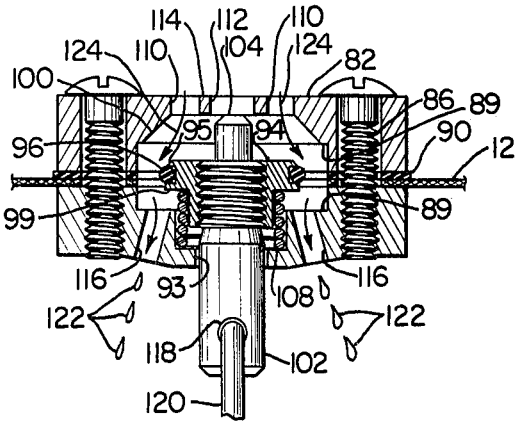
FIG. 12 is a similar cross-sectional view to FIG. 11 with the exception that the valve stem is shown in open position.

As shown in FIG. 12, when the valve stem 102 is pulled axially downwardly against the bias of spring 108, the valve face 95 and O-ring 96 of the disk 94 are displaced from the valve seat 100 allowing water to flow through the inlet orifices 110, 112, into the chamber 89 as indicated by the flow arrows 124. The water in the chamber 89 is then distributed and allowed to flow out of the chamber through the outlet ports 116 in the form of a plurality of small streamlets or droplets 122 in the form of a shower. A flexible cord 120 threaded through hole 118 in the bottom of valve stem 102 facilitates pulling the valve stem 102 downwardly to open the valve. As long as a pulling force is maintained on the cord 120, the valve stem remains open allowing water to flow through the shower head. However, as soon as the pull on cord 120 is released, the spring 108 pushes the valve stem 102 axially upwardly into closed position.

Figure 13:
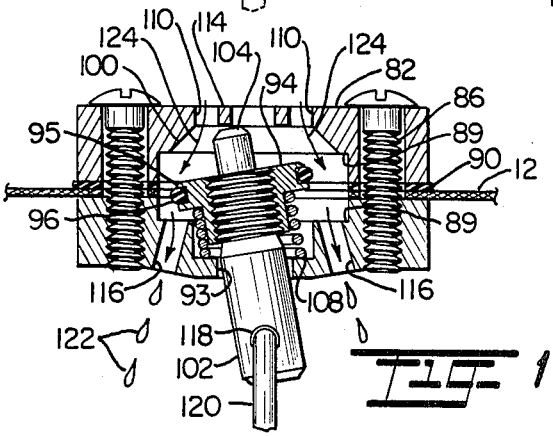
FIG. 13 shows a cross-section of the valve similar to FIG. 11 with the exception that the valve stem is cocked sideways and locked in open position.

A significant feature included in this invention allows the valve to be easily locked in open position against the bias of the spring 108 as shown in FIG. 13. As illustrated, the valve stem 102 can also be rotated about an axis perpendicular to the longitudinal axis of the valve stem 102, i.e., cocked sideways out of axial alignment with the hole 93 and inlet orifice 112. This cocking movement can be accomplished by first pulling the valve stem 102 into the open position as shown in FIG. 12, in which position the finger 104 is pulled downwardly a sufficient distance to clear the section 114 of upper body portion 82, and then pulling the cord 120 to one side causing the valve stem 102 to be cocked sideways, as shown in FIG. 13 with the finger 104 then positioned under the segment 114 of upper body portion 82. With the valve stem 102 in this cocked position, the pull on cord 120 can be released, and the finger 104 will engage or abut against the segment 114, thereby preventing the valve stem 102 from moving upwardly into closed position. As shown by the flow arrows 124 in FIG. 13, the water can continue to flow through the shower head when the valve stem 102 is cocked into this locked open position.

In order to close the valve, a person need only pull straight downward on cord 120 which will move the valve stem back into axial alignment with the hole 93 and inlet orifice 112 and then release the pull on cord 120 allowing the spring 108 to again move the valve stem 102 into closed position. It can be appreciated therefore that the shower head and valve apparatus 80 of this second embodiment can also be conveniently operated by use of only one hand manipulating a flexible cord 120.

Another feature of the present invention which enhances the compactness and convenience of this shower head and valve apparatus 80 for use in combination with a garment is shown in FIG. 11. As described above, the valve stem 102 is threadedly received within the internally threaded bore 97 of disk 94. Therefore, the valve stem 102 can be unscrewed from the disk 94 and removed from the shower head as indicated in broken lines in FIG. 11. It can then be placed in a knapsack or in a pocket until required for use and thus will not be prone to catch on tree branches, rocks and other objects when the poncho is worn as a garment.

It can therefore be appreciated that this novel invention is fully capable of serving dual functions as a protective rain garment during times of inclement weather and a portable shower at other times, thereby giving the user the convenience of both the protective garment and the shower while requiring him to bear the burden of carrying essentially one item. It can also be appreciated that the unique combination valve and shower head provided in this invention for the portable shower enables one to conveniently control the flow of water at any desired rate from no flow to maximum flow including sustained flow in the full flow position by the simple pulling manipulation of a valve cord.

Although the present invention has been described with a certain degree of particularity, it is understood that the present disclosure has been made by way of example and that changes in details of structure may be made without departing from the spirit thereof.

I claim:

1. In a portable shower, a shower head and valve apparatus, comprising:

a housing with an upper body portion and a lower body portion enclosing a chamber in the space between said upper and lower body portions, said upper and lower body portions each having a hole from the exterior to the interior of said chamber, the hole in said upper body portion being axially aligned with the hole in said lower body portion, and a portion of the hole in said upper body portion having a progressively decreasing diameter defining a hole portion with upwardly converging sidewalls, a valve stem member slidably extending through the hole in said lower body member and extending upwardly through said chamber and into said hole portion of said upper body portion, said valve stem including sealing means at its upper end, closing means normally urging said sealing means into sealing contact with said converging hole portion, and limit stop means on said valve stem operative to retain said valve in an open position and resist the urging of said closing means, and said lower body portion including ports extending from the internal surface of said lower body porton to the external surface such that when said valve stem is moved downwardly allowing water to flow into said chamber through the opening between said converging sidewalls and said sealing means, said ports conduct the water in droplet form from said chamber to the underside of said shower head and valve apparatus for release in the form of a shower.

2. The portable shower head and valve apparatus of claim 1, wherein the waterproof fabric of a shower reservoir is sandwiched and squeezed in sealing relation between said upper body portion and said lower body portion to attach said shower head and valve apparatus to said reservoir.

3. The portable shower head and valve apparatus of claim 1, including a pull cord attached to the lower end of said valve stem to enhance the manual operation of said valve apparatus.

4. The portable shower head and valve apparatus of claim 1, wherein said limit stop means includes an annular channel around the circumference of said valve stem near its midsection, the width of said channel being at least as great as the thickness of said lower body portion, whereby said channel is operative to engage said lower body portion when said valve stem is pulled downwardly and cocked to one side.

5. The portable shower and valve apparatus of claim 4, including a circular grooved notch in said external surface of said lower body portion in close proximity to and encompassing said hole in said lower body portion to engage said circumferential channel in said valve stem whereby to assist in maintaining said valve stem in a cocked open position resisting the force urging said valve stem to the closed position.

6. A liquid dispenser adapted for dispensing liquid from a reservoir, comprising:

a housing having a hollow chamber therein and adapted for mounting in association with said reservoir with the exterior of the upper portion thereof exposed to the liquid in said reservoir and with the exterior of the lower portion thereof outside said reservoir, said upper portion having an inlet orifice therein extending from the exterior thereof into said chamber for conducting liquid from said reservoir into said chamber, said lower portion having an outlet port therein extending from said chamber to the exterior of said housing for conducting liquid from said chamber to the outside of said reservoir, and a hole through said lower portion extending from the exterior thereof into said chamber; and a valve stem slidably positioned in said hole, the upper portion of said valve stem being positioned in said chamber in alignment with said inlet orifice, and the lower portion of said valve stem protruding through said hole to the exterior of said housing, said valve stem being adapted to close and open said inlet orifice when moved in the direction of its longitudinal axis inwardly and outwardly in relation to said housing, bias means for urging said valve stem inwardly to the closed position, said valve stem also being rotatable to limited extent about an axis normal to its longitudinal axis when it is moved outwardly to the open position, and retainer means on said valve stem for engaging a portion of said housing adjacent said valve stem and retaining said valve stem in an open position against the urging of said bias means.

7. The liquid dispenser of claim 6, wherein said retainer means includes an annular channel around the circumference of said valve stem near its midsection, the width of said channel being at least as great as the thickness of said lower portion of said housing adjacent said valve stem and adapted to engage said lower portion when said valve stem is in open position and rotated about an axis normal to its longitudinal axis.

8. The liquid dispenser of claim 7, wherein said inlet orifice in said upper portion and said hole in said lower portion are in axial alignment with each other on opposite sides of said chamber, said outlet port is laterally offset from said hole, and said bias means includes an extension on said valve stem protruding axially upwardly from the upper end of said valve stem and through said inlet orifice to the exterior of said housing and terminating at its distal end in an enlarged collar, and a compression spring positioned between said collar and the exterior surface of said housing with one end of said spring bearing on said collar and the other end bearing on said housing to urge said valve stem upwardly toward said inlet orifice.

9. The liquid dispenser of claim 8, wherein said inlet orifice is tapered inwardly toward its axis from its juncture with the chamber upwardly toward its juncture with the exterior surface of the housing, the tapered surface of said orifice being a valve seat, and said valve stem includes a sealing surface on its upper end adapted to interface with said valve seat to prohibit flow of liquid through said inlet orifice into said chamber when said valve is urged upwardly to said interfacing position.

10. The liquid dispenser of claim 9, wherein said upper and lower portions of said housing are separable and adapted to receive and clamp therebetween the wall of the reservoir to attach said housing to said reservoir, and further including a plurality of outlet ports positioned in radially outward spaced relation around said hole, each of said ports being directed downwardly and outwardly to conduct and direct liquid in the form of small streamlets and droplets from said chamber through said lower portion of said housing and distribute it outwardly in the form of a shower.

11. The liquid dispenser of claim 6, wherein said retainer means includes a finger extending axially upward from the upper end of said valve stem and adapted to engage the interior surface of said upper portion when said valve stem is in open position and rotated about an axis normal to its longitudinal axis.

12. The liquid dispenser of claim 11, wherein the upper portion of said chamber converges upwardly and inwardly, the walls of said converging portion being a valve seat, and said valve stem includes a sealing surface around the periphery of its upper end adapted to interface with said valve seat to prohibit flow of liquid through said inlet orifice into said chamber when said valve is urged upwardly to said interfacing position.

13. The liquid dispenser of claim 12, wherein said bias means includes a collar around the peripheral surface of said valve stem inside said chamber and a compression spring positioned between said collar and the interior surface of the lower portion of said housing with one end bearing on said collar and the other end bearing on said housing to urge said valve stem upwardly toward said inlet orifice.

14. The liquid dispenser of claim 13, including an enlarged disk mounted on the upper end of said valve stem, said collar being a portion of said disk extending radially outward from said valve stem, said sealing surface being around the periphery of said collar.

15. The liquid dispenser of claim 14, wherein said disk has an internally threaded bore therethrough, and said valve stem has an externally threaded portion on its upper end with a diameter smaller than the diameter of said hole in said lower portion of said housing and adapted to be threadedly received and retained in said disk as well as removable from said housing through said hole when not threadedly retained in said disk.

16. The liquid dispenser of claim 15, including a plurality of inlet orifices in said upper portion of said housing extending inwardly into said chamber, one of said inlet orifices being in axial alignment with said hole in said lower portion of said housing and adapted to receive said finger when said valve stem is in closed position, and the remaining of said inlet orifices being distributed around said one orifice, said finger being adapted to engage said upper portion of said housing adjacent said one orifice when said valve stem is in open position and rotated about an axis normal to its longitudinal axis.

17. A shower head and valve apparatus adapted for mounting in the wall of a reservoir, comprising:

a housing with a chamber therein, said housing being in two separate portions including an upper portion and a lower portion adapted to be fastened together with a portion of the wall of the reservoir sandwiched and squeezed in sealing relation therebetween, the upper portion of said chamber converging upwardly and inwardly, said converging portion being a valve seat and said housing also having an inlet orifice extending through said upper portion of said housing from the exterior surface thereof into said chamber, a hole through the bottom portion of said housing in axial alignment with said inlet orifice, and a plurality of outlet ports distributed around said hole a spaced distance therefrom and extending through said lower portion of said housing from said chamber to the exterior surface of said housing;

a valve stem slidably positioned in said hole and extending upwardly into said chamber, said valve stem having an enlarged collar around its peripheral surface near its upper end with a sealing surface around the periphery of said collar adapted for interfacing with said valve seat to seal against water flowing through said inlet orifice into said chamber when said valve stem is in closed position, said valve stem adapted to be cocked sideways out of axial alignment with the axis of said hole and said inlet orifice when said valve stem is in the open position; and a compressor spring positioned between and bearing against said collar and the lower portion of said housing to urge said valve stem upwardly into closed position.

18. The shower head and valve apparatus of claim 17 including an enlarged disk secured to the upper end of said valve stem, said collar and said sealing surface being a part thereof, and said valve stem being detachable from said disk and removable from said housing when said disk is in closed position.

* * * * *